US006457457B1

(12) United States Patent
Harcombe

(10) Patent No.: US 6,457,457 B1
(45) Date of Patent: Oct. 1, 2002

(54) CONTROL METHOD

(75) Inventor: Anthony Thomas Harcombe, Richmond (GB)

(73) Assignees: Delphi Technologies, Inc., Troy, MI (US); Caterpillar Inc., Peoria, IL (US)

( * ) Notice: Subject to any disclaimer, the term of this patent is extended or adjusted under 35 U.S.C. 154(b) by 0 days.

(21) Appl. No.: 09/154,386

(22) Filed: Sep. 16, 1998

(30) Foreign Application Priority Data

Sep. 20, 1997 (GB) ..... 9720003

(51) Int. Cl.[7] ..... F02M 51/00
(52) U.S. Cl. ..... 123/490; 361/154
(58) Field of Search ..... 123/467, 490; 361/154, 155

(56) References Cited

U.S. PATENT DOCUMENTS

| | | | | | |
|---|---|---|---|---|---|
| 2,934,050 | A | * | 4/1960 | Pribble | 123/490 |
| 2,970,246 | A | * | 1/1961 | Gunkel | 123/490 X |
| 3,021,454 | A | * | 2/1962 | Pickens | 123/490 X |
| 3,433,207 | A | * | 3/1969 | Bassot et al. | 123/490 |
| 3,665,898 | A | * | 5/1972 | Kamazuka | 123/490 |
| 3,682,144 | A | * | 8/1972 | Suda | 123/490 |
| 4,345,564 | A | * | 8/1982 | Kawamura et al. | 361/154 X |
| 5,267,545 | A | * | 12/1993 | Kitson | 123/490 |
| 5,694,903 | A | * | 12/1997 | Ganser | 123/467 X |
| 5,717,562 | A | * | 2/1998 | Antone et al. | 361/155 |
| 6,158,419 | A | * | 12/2000 | Jett et al | 123/446 |

FOREIGN PATENT DOCUMENTS

WO 9701031 * 1/1997

OTHER PUBLICATIONS

D. Van Nostrand Company Inc., "The International Dictionary of Physics and Electronics", 2nd Edition, 1961.*
Abstract of JP 4,183,967, Takashi, Jun. 1992.*
Abstract of JP 3,179160, Hiroyuki, Aug. 1991.*

* cited by examiner

*Primary Examiner*—Robert M. Fetsuga
(74) *Attorney, Agent, or Firm*—Michael Best & Friedrich LLP

(57) ABSTRACT

A method of controlling an electromagnetically operated actuator for a valve arrangement. The valve arrangement is responsive to an actuator armature. The actuator has a winding and is preferably of the two-stage lift type. The method includes applying a first, low voltage to the actuator, using a first voltage source, to generate a relatively low rate of current increase through the actuator winding, thereby to impart a force to the armature to cause the armature to move relatively slowly from a rest position to a first intermediate position. The method also includes applying a second, higher voltage to the actuator, using a second voltage source coupled to the first voltage source through a regeneration path, to generate a relatively high rate of current increase through the actuator winding, thereby to impart a force to the armature to cause the armature to move relatively quickly from the first intermediate position to a second position.

4 Claims, 2 Drawing Sheets

CONTROL METHOD

This invention relates to a method of controlling a drive circuit for use in controlling the operation of a valve actuator. The invention is particularly suitable for use in controlling the operation of an actuator of the two-stage lift type in which, when the actuator is energized to apply a relatively low magnitude force to the armature, the armature thereof moves from a rest position to a first position, the energization of the actuator to apply a higher magnitude force to the armature resulting in the armature moving from the first position to a second position, but is also suitable for use in other applications.

An actuator of the type described hereinbefore could be controlled using a high voltage supply and using an appropriate switching arrangement to turn the current on and off to control the mean applied current.

Where the actuator is used to control a pair of valves, one of which controls communication between the pumping chamber of a fuel injector and a low pressure drain, the other valve controlling the timing of fuel injection, although movement of the said other valve is required to occur rapidly, control of the said one valve need not be as accurate, relatively slow movement of the said one valve being acceptable, and may be preferable as the slow movement of the said one valve reduces the risk of accidental, unwanted early movement of the said other valve.

According to a first aspect of the invention there is provided a method of controlling an electromagnetically operated actuator of the two-stage lift type comprising applying a first, low voltage to the actuator to generate a relatively low magnitude actuator force, and applying a second higher voltage to the actuator to generate a relatively large magnitude actuator force.

Preferably, the relatively low magnitude actuator force is sufficient to move an armature from its rest position to its first position against a first spring loading, the relatively large magnitude actuator force being sufficient to cause movement of the armature to its second position against a second spring loading.

In one mode of operation, the armature is moved to its first position, held in that position and is subsequently moved to its second position.

The use of the low voltage, for example battery voltage, results in a relatively low rate of current increase in the actuator winding, and hence in relatively slow movement of the armature to its first position, but as the rate of movement of the armature during this part of the valve's operating cycle is not critical, the low rate of movement is not of great importance. The use of low voltage during this part of the operating cycle improves the efficiency of the actuator drive circuit.

In an alternative mode of operation, the second voltage is applied to cause the armature to move to its second position, and at a subsequent point in the operation, the second voltage is removed and the first voltage applied, the armature moving to its first position.

There may be occasions in which the battery voltage is insufficient to cause movement of the armature to its first position during the time available, and in these circumstances the application of the first, low voltage may be preceded, interrupted or followed by a period during which high voltage is applied to the actuator to assist in moving the armature to its first position. The application of the higher voltage preferably precedes the application of the low voltage in these circumstances. Movement of the armature to its second position occurs upon the subsequent application of the high voltage as described hereinbefore.

According to another aspect of the invention there is provided a method of controlling an electromagnetic actuator comprising using a low voltage source to energize a winding of the actuator, and using a high voltage source to assist in energization of the actuator in the event that the low voltage source is unable to energize the actuator to a desired extent within a predetermined period.

The voltage of the low voltage source may be monitored and used in determining when to use the high voltage source to assist in energization of the actuator. Alternatively the actuator response time or the time taken for the winding current to rise to a predetermined level may be used to determine whether or not to use the high voltage source.

The invention will further be described, by way of example, with reference to the accompanying drawings, in which.

Figure 1:
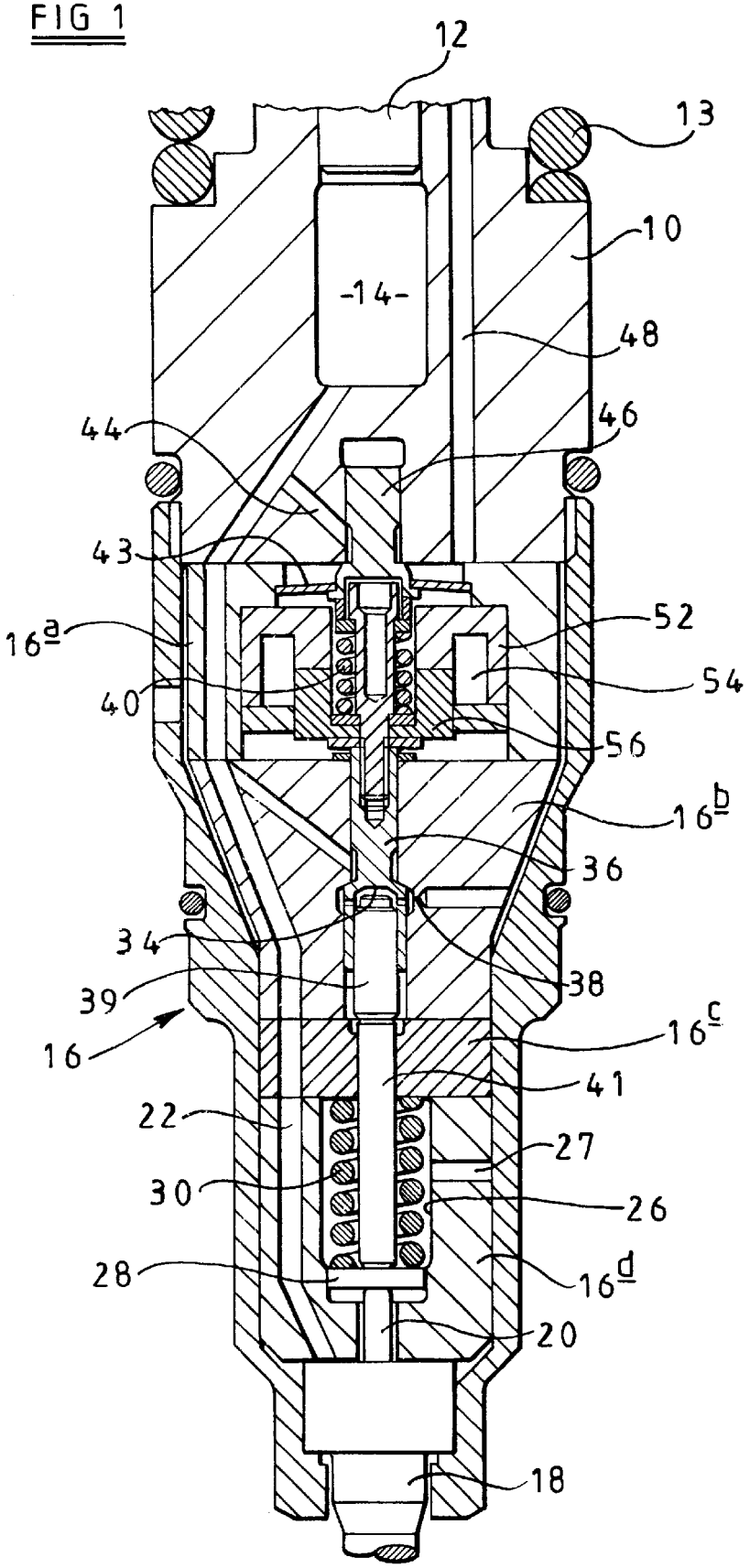
FIG. 1 illustrates an injector including an electromagnetically actuated valve arrangement.

FIG. 1 illustrates a pump injector which comprises a pump body 10 provided with a bore within which a plunger 12 is reciprocable, the plunger 12 and bore together defining a pumping chamber 14. A multi-part control valve housing arrangement 16*a*, 16*b*, 16*c*, 16*d* is located upon the pump body 10, and a nozzle body 18 is mounted upon the control valve housing arrangement 16. The nozzle body is provided with an axially extending blind bore within which a valve needle 20 is slidable, the valve needle 20 being engageable with a seating defined adjacent the blind end of the bore. The bore communicates through a passage 22 with the pumping chamber 14, and the engagement of the valve needle 20 with its seating controls communication between the pumping chamber 14 and one or more outlet openings provided in the nozzle body 18 downstream of the seating.

The control valve housing arrangement 16 includes a bore which extends coaxially with the bore of the nozzle body 18, the bore of the control valve housing arrangement 16 defining a spring chamber 26. An end of the valve needle 20 extends into the spring chamber 26, and carries a spring abutment 28 which is engaged by a spring 30 arranged to bias the valve needle 20 into engagement with its seating. The spring chamber 26 communicates through a passage 27 with a low pressure drain.

A control valve member 36 is slidable within a bore coaxial with the spring chamber 26, the control valve member 36 being engageable with a seating to control communication between the passage 22 and a control chamber 34 which communicates through a restricted passage 38 with a low pressure drain reservoir. The control chamber 34 is defined by a drilling provided in the control valve member 36 within which a piston 39 is slidable, movement of the piston 39 being transmitted through a rod 41 to the needle 20. The control valve member 36 is biased by a disc spring 43 away from its seating, the biasing force being transmitted through a spring 40 engaged between a member carried by the control valve member 36 and a drain valve member 46 described hereinafter.

The pumping chamber 14 communicates through a passage 44 with a bore within which the drain valve member 46 is slidable, the drain valve member 46 extending coaxially with the control valve member 36. The drain valve member 46 is engageable with a seating to control communication between the passage 44 and a passage 48 which communicates with the low pressure drain reservoir. The disc spring 43 is arranged to bias the drain valve member 46 away from its seating.

An actuator is mounted within the arrangement 16, the actuator comprising a stator 52 including an energizing coil 54, and an armature 56 which is moveable relative to the stator 52. The armature 56 is secured to the control valve member 36.

In use, with the plunger 12 moving in an upward direction under the action of a spring 13, and with the actuator de-energized, fuel is drawn from the low pressure drain reservoir past the drain valve member to the pumping chamber 14. Subsequently, the plunger 12 will reach its outermost position, and will commence inward movement under the action of a cam arrangement (not shown). The inward movement of the plunger displaces fuel from the pumping chamber 14 past the drain valve member 46 to the low pressure drain reservoir. During this part of the pump injector operation, the spring 30 maintains the valve needle 20 in engagement with its seating.

Subsequently, when it is desired to commence pressurization of fuel, a relatively low voltage, for example battery voltage, is applied to the coil 54 resulting in movement of the armature 56 against the action of the disc spring 43. The movement of the armature 56 results in the drain valve member 46 moving into engagement with its seating, but is insufficient to cause the control valve member 36 to engage its seating.

Once the drain valve member 46 engages its seating, continued inward movement of the plunger 12 results in fuel within the pumping chamber 14 being pressurized. As during this stage of the pumping operation, the control valve member 36 is lifted from its seating, and as fuel is only able to escape from the control chamber 34 to the low pressure drain reservoir at a restricted rate through the passage 38, the fuel pressure within the control chamber 34 increases. The action of the fuel pressure within the control chamber 34 upon the valve needle 20 together with the action of the spring 30 is sufficient to ensure that the valve needle 20 remains in engagement with its seating during this part of the pumping operation.

When injection is to be commenced, a higher voltage, for example 50V, is applied to the coil 54 resulting in further movement of the armature 56. As during this part of the movement of the armature 56, the drain valve member 46 engages its seating, the armature 56 moves against the action of the spring 40. The movement of the armature 56 results in the control valve member 36 moving into engagement with its seating. The movement of the control valve member 36 prevents fuel from entering the control chamber 34, the passage 38 continuing to allow fuel to escape from the control chamber 34. The fuel pressure within the control chamber 34 therefore falls and reaches a level insufficient to maintain the valve needle 20 in engagement with its seating. The valve needle 20 thus moves against the action of the spring 30 allowing fuel delivery through the outlet opening. This position is illustrated in FIG. 1.

In order to terminate injection, the coil 54 is de-energized to a sufficient extent to allow the control valve member 36 to lift from its seating. Fuel enters the control chamber 34, thus the fuel pressure within the control chamber 34 increases, and a point is reached beyond which the fuel pressure within the control chamber 34 is sufficient to cause the valve needle 20 to move into engagement with its seating.

If a further injection is required whilst the plunger 12 continues to move inwards, the coil 54 is energized once more to move the control valve member 36 into engagement with its seating, termination of injection occurring as described hereinbefore.

After termination of injection, the coil 54 is completely de-energized, the disc spring 43 returning the armature 56 to its starting position, and lifting the drain valve member 46 from its seating to permit fuel from the pumping chamber 14 to escape to the low pressure drain reservoir. Continued inward movement of the plunger 12 displaces further fuel to the low pressure drain reservoir. Subsequently, the plunger 12 commences outward movement under the action of the return spring resulting in the pumping chamber 14 being charged with fuel at low pressure as described hereinbefore.

Figure 2:
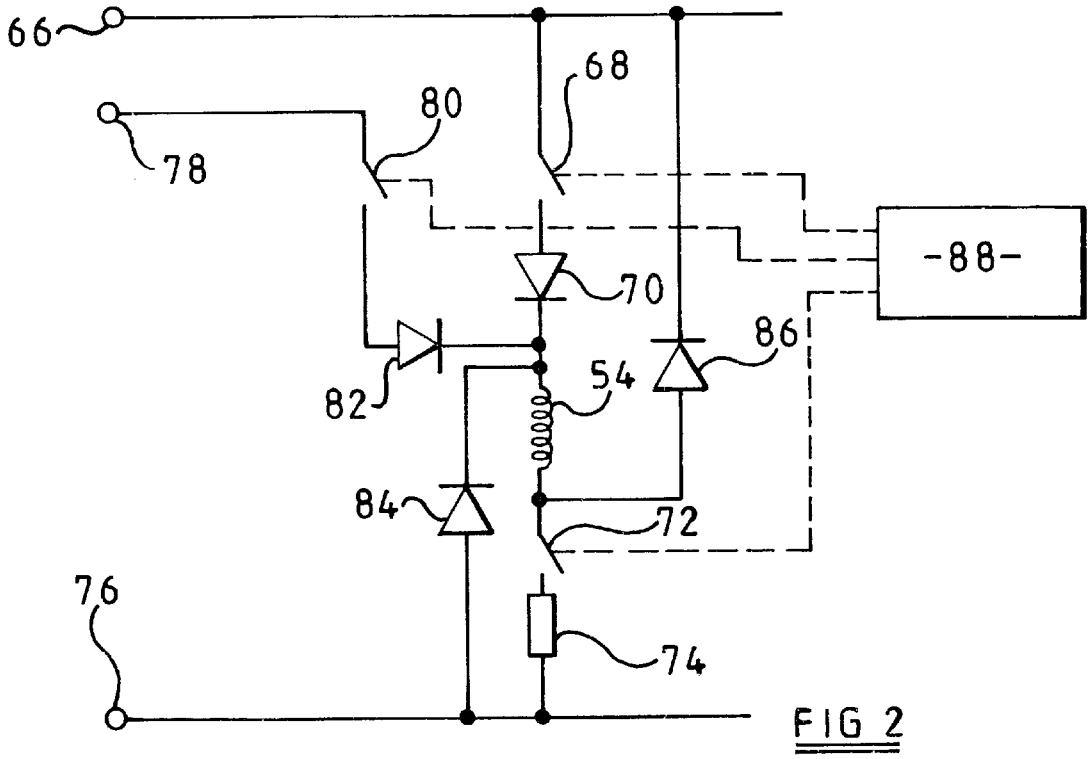
FIG. 2 is a diagram of a drive circuit suitable for use in controlling the actuator of the valve arrangement shown in FIG. 1.

FIG. 2 illustrates a drive circuit for use in controlling the operation of the coil 54. As illustrated in FIG. 2, a high voltage terminal 66 is connected through a first switch 68 and diode 70 with a first end of the coil 54. A second end of the coil is connected through a second switch 72 and a resistor 74 with a terminal 76 at ground voltage. A low voltage terminal 78 is connected through a third switch 80 and a diode 82 with the first end of the coil 54. The first end of the coil 54 is also connected through a diode 84 with the ground terminal 76, and the second end of the coil 54 is connected through a diode 86 with the high voltage terminal 66. The diodes 84, 86 form a regeneration flow path whereby the coil can be used to charge the high voltage source to an appropriate level, in use. It will be appreciated that the diodes may be replaced by other equivalent devices of components, for example synchronous rectifiers. The first, second and third switches 68, 72, 80 conveniently take the form of transistors which are operated under the control of a controller 88.

Figure 3:
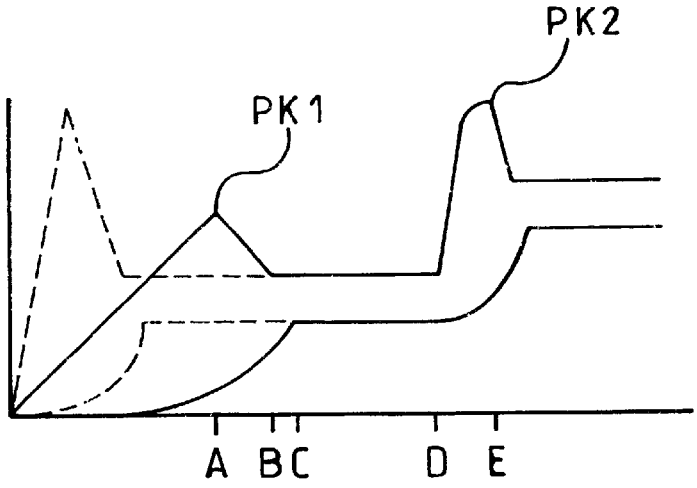
FIG. 3 is a diagram illustrating the current flowing through the actuator and the associated movement of the armature of the actuator.

Referring to FIG. 3, in order to commence pressurization of fuel in the pump injector, the second and third switches 72, 80 are both closed, applying a low voltage to the coil 54, resulting in the current flowing in the coil 54 rising at a low rate. The current is allowed to rise to a peak value PK1, and as shown in FIG. 3, this value is reached at a time A. Once the peak current level PK1 has been reached, the third switch 80 is opened allowing the current to decay at a low rate through the second switch 72. The current is allowed to continue to decay until the desired current level is reached at which the armature 56 is or will be held against the action of the disc spring 43 in the position in which the drain valve member 46 engages its seating, but the control valve member 36 does not engage its seating. Once this current has been reached, an appropriate signal is applied to the third switch 80 to open and close the switch repeatedly using an appropriate chopping technique in order to hold the current at the desired current level. As shown in FIG. 3, the current reaches the desired level at time B, time C indicating the instant at which the armature reaches the desired position. As shown in FIG. 3, movement of the armature commences, in this embodiment, prior to the peak value PK1 being reached.

At a subsequent time, a signal is sent by the controller 88 to open the third switch 80 and close the first switch 68. This has the effect of applying a high voltage across the coil 54 resulting in a rapid rate of increase in the current flowing through the coil 54. In FIG. 3, the instant at which the first switch 68 is closed is indicated at time D. The application of the higher voltage across the coil 54 results in the generation of a magnetic field sufficient to cause further movement of the armature 56 against the action of the spring 40, and the lower trace in FIG. 3 indicates that the armature 56 commences movement towards a second position. The current rises to a second peak value PK2 at time instant E, and once this current level has been achieved, the first switch 68 is opened to allow the current to decay to a second desired current level, the switch 80 then being opened and closed using the chopping technique mentioned hereinbefore to hold the current flowing through the coil 54 at the second desired level.

The dashed lines on FIG. 3 illustrate the effect of closing the first switch 68 rather than the third switch 80 in order to cause movement of the armature from its rest position towards its first position. As closing the first switch 68 applies a high voltage across the coil 54, the armature 56 would commence movement earlier, and hence reach the first position earlier than occurs where a relatively low voltage is applied across the coil 54.

As described hereinbefore, during this part of the operating cycle of the pump injector, relatively fast movement of the armature is of little importance, but there is a significant power saving in using low voltage rather than high voltage to cause movement of the armature to its first position. Further, the rapid movement of the armature may result in accidental, undesired movement of the control valve member.

In an alternative mode of operation of the injector described hereinbefore, the coil may be energized using the high voltage supply, causing both valves to close. Shortly after completion of such movement, the coil is de-energized rapidly by removing the high voltage supply, instead connecting to coil to the low voltage supply. As a result, although the drain valve remains closed, the control valve member returns to its open position, thus ensuring that injection does not occur. Subsequently, the coil is energized using the high voltage supply to cause injection to commence as described hereinbefore. Such a mode of operation may be used to achieve a pilot injection followed by a main injection.

Figure 4:
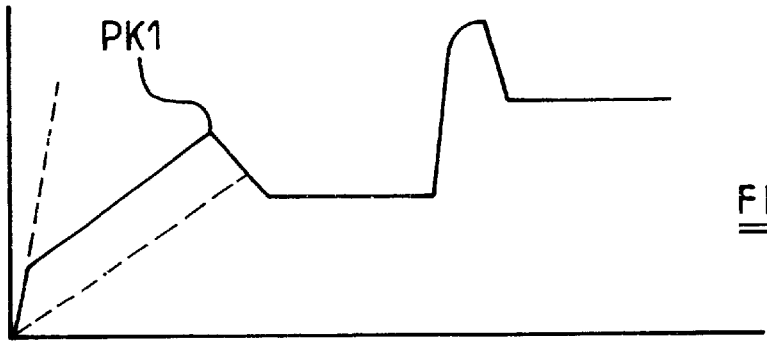
FIG. 4 is a diagram similar to FIG. 3 showing an alternative current waveform.

There may be occasions, for example upon start up of the motor, where the battery from which power is drawn is insufficiently charged to enable low voltage to be used to cause movement of the armature towards its first position. FIG. 4 illustrates an example in which the battery voltage is insufficient to allow the peak current PK1 to be reached within an acceptable time period, and in order to compensate for this, prior to switching the third switch 80 to apply a low voltage across the coil 54, the first switch 68 is closed to apply a high voltage for a short interval, and subsequently the first switch 68 is opened and the third switch 80 used to control the voltage applied across the coil 54 as described hereinbefore to control movement of the armature towards the first position. It will be appreciated that the application of high voltage for a short interval may interrupt or follow the application of low voltage rather than precede it as described hereinbefore.

The technique described hereinbefore for compensating for low battery voltage levels may be used with other types of actuator, for example single stage lift actuator, and is not limited to use with the two-stage lift actuator described hereinbefore. In use, the battery voltage may be monitored in order to determine whether or not energization will require the use of the high voltage supply, for example by measuring the battery voltage 100 $\mu$S before injection is to take place. Alternatively, the responsiveness of the actuator may be monitored or the time taken for the winding current to reach a predetermined level may be used in determining whether or not the high voltage supply is to be used in energizing the actuator. The amount of assistance to be provided using the high voltage supply may be determined using a micro-controller or using an appropriate look-up table. The high voltage supply may also be used if it is determined that the battery voltage is insufficient to hold the armature in its actuated position.

Although the description hereinbefore relates to the application of the invention to a pump injector of the type illustrated in FIG. 1, it will be appreciated that the method of controlling the actuator is applicable to arrangements other than the pump injector illustrated in FIG. 1, and is also suitable for use in other fuel injection valve arrangements.

The current waveform used to control the operation of injector described hereinbefore may be adapted to include regions at which the current decay rate is relatively low, and other regions at which the current is allowed to decay more rapidly. Further, sensing means may be included whereby movement of the valve members to their fired positions is sensed, for example by sensing a discontinuity or glitch in the current waveform in a known manner.

I claim:

1. A method of controlling an electromagnetically operated actuator for a valve arrangement, the valve arrangement being responsive to movement of an actuator armature, the actuator being of the two-stage lift type, and having an actuator winding, the method comprising:

applying a first, low voltage to the actuator, using a first voltage source, to generate a relatively low rate of current increase through the actuator winding, thereby to impart a force to the armature to cause the armature to move relatively slowly from a rest position to a first intermediate position; and applying a second, higher voltage to the actuator, using a second voltage source coupled to the first voltage source through a regeneration path, to generate a relatively high rate of current increase through the actuator winding, thereby to impart a force to the armature to cause the armature to move relatively quickly from the first intermediate position to a second position.

2. A method as claimed in claim 1, wherein the relatively low rate of current increase through the actuator winding is sufficient to move the armature from the rest position to the first intermediate position against a first spring loading, the relatively high rate of current increase through the actuator winding being sufficient to move the armature to the second position against a second spring loading.

3. A method as claimed in claim 2, wherein the armature is moved to its first position, held in that position and subsequently moved to its second position.

4. A method of controlling an electromagnetic actuator, the method comprising:

applying a first, low voltage to the actuator using a first voltage source to energize a winding of the actuator, to generate a relatively low rate of current increase through the actuator winding, and move an armature from a rest position to a first intermediate position; applying a second, higher voltage to the actuator using a second voltage source coupled to the first voltage source through a re-generation path to further energize the winding of the actuator, to generate a relatively high rate of current increase through the actuator winding, and to move the armature to a second position.

* * * * *